US005505317A

United States Patent [19]

Rulis et al.

[11] Patent Number: 5,505,317

[45] Date of Patent: Apr. 9, 1996

[54] DOOR HINGE HELD CATCHALL RACK

[76] Inventors: Robert A. Rulis, 3147 Larmier St., Denver, Colo. 80205; John B. Shattuck, 4080 Chippewa Dr., Boulder, Colo. 80303

[21] Appl. No.: 248,719

[22] Filed: May 25, 1994

[51] Int. Cl.[6] ..... A47F 5/00

[52] U.S. Cl. ..... 211/86; 211/96

[58] Field of Search ..... 211/96, 168, 165, 211/150, 81, 75

[56] References Cited

U.S. PATENT DOCUMENTS

| | | | |
|---|---|---|---|
| 2,539,803 | 1/1951 | Westberg | 211/96 |
| 2,684,225 | 7/1954 | Johnson | 211/86 |
| 2,895,698 | 7/1959 | Palmer | 211/96 |
| 3,175,696 | 3/1965 | Milbourne | 211/86 |
| 4,721,212 | 1/1988 | Lowe | 211/86 |

*Primary Examiner*—Leslie A. Braun
*Assistant Examiner*—Anita King

[57] ABSTRACT

A pivoting door hinge held catchall rack including a rod which extends vertically along a plurality of door hinges and which is held by the pins of the door hinges threaded through flanges on either end of the rod and/or through screw-eye type devices which are easily threaded into a slot in back of the rod and therefore can be readily aligned with the tops of the hinges. From the rod are extended, appended, fixed or attached a plurality of catchall devices, shapes and forms.

3 Claims, 2 Drawing Sheets

DOOR HINGE HELD CATCHALL RACK

The present invention pertains to a shaped rod hung from a plurality of hinges on a door. From this rod are fixed or extended or attached a plurality of catchall items including, but not limited to, pegs, hooks, cups, trays, clips, pins, knobs, weapon-holding devices, mirrors, rods, hangers, and other catchall forms. The rod may be configured to hold a plurality of only one category of the catchall items, such as all hooks, for example, or a weapons-holding device. On the other hand, the rod may be configured to hold multiple categories of catchall items.

BACKGROUND OF THE INVENTION

Temporary or permanent arrangements to hold personal items in order to have them handy typically range from shelves, tables, dresser tops or drawers, counter tops, boxes, cabinets, hooks, hangers and so forth. There never seems to be enough space for this type storage and the space set aside for this is usually overloaded, unsightly and generates frustration in finding things. Finding new, out of the way, generally unused space, and putting it to a single purpose use: a catchall rack, fulfills a continuing need. The present invention substantially fulfills this need.

The applicants are unable to find any prior art background references pertaining to the present invention.

SUMMARY OF THE INVENTION

The present invention comprises a shaped rod hung from a plurality of hinges of a door. From this rod are fixed or extended or attached a plurality of items including, but not limited to, pegs, hooks, cups, trays, clips, pins, knobs, weapon-holding devices, mirrors, rods, hangers, and other catchall forms. The rod is held on by the pins of the door hinges so that it pivots on the hinges as the door is opened and closed. Thusly, the space behind doors opening into a room becomes very useful and is out of the way. This is particularly advantageous in bathrooms, laundry rooms, garages, storerooms and other small rooms.

Another aspect of the present invention is the shape of the rod and the plurality of catchall items held by the rod. The rod may contain such catchall items as only hooks, or only pegs, or only cups for jewelry, or a mixed array of all of the foregoing, or only a means to secure a rifle, gun or other weapon behind a door.

Another aspect of the invention is a groove or slot along the back of the rod to allow the quick, easy insertion of a plurality of screw eyes, or other support means precisely along the rod where they are needed to attach the rod to the pins of the door hinges.

Other aspects, features and details of the present invention can be more completely understood by reference to the following detailed description of the preferred embodiment, taken in conjunction with the drawings and from the appended claims.

DETAILED DESCRIPTION OF THE DRAWINGS

DESCRIPTION OF THE PREFERRED EMBODIMENT

Figure 1:
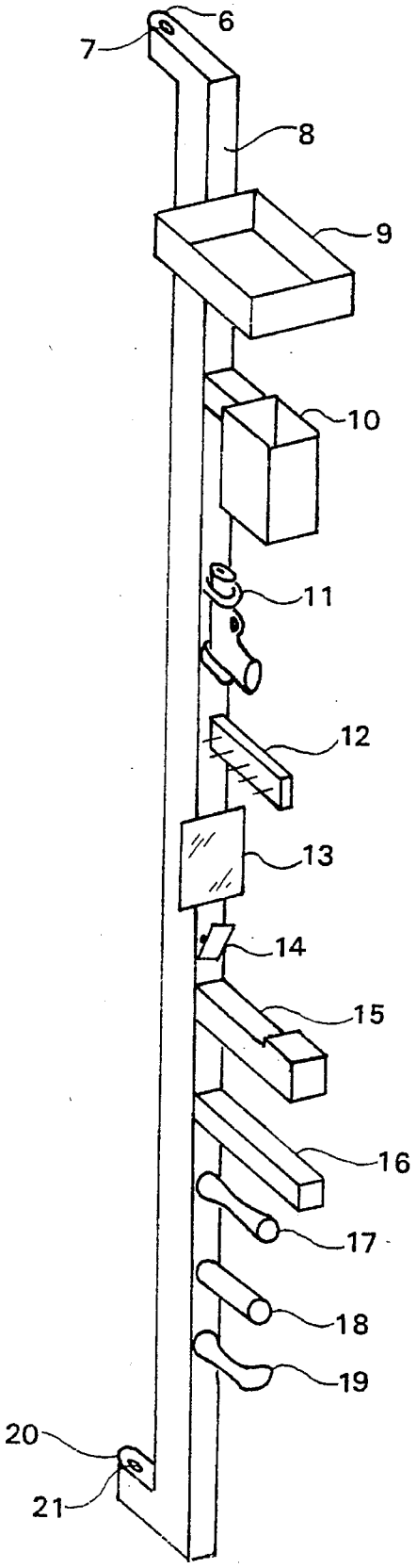
FIG. 1 is an isometric view of the catchall rack embodying the present invention.

A catchall rack embodying the present invention includes a rod 8 (FIG. 1) from which a plurality of catchall forms as represented by tray 9, cup 10, weapons rack 11, tie pins 12, mirror 13, clip 14, hook 15, rod 16, knob 17, peg 18, hanger 19.

Figure 2:
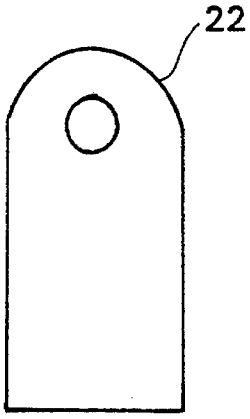
FIG. 2 is an enlarged drawing of flanges protruding from the back of the top and bottom ends of the catchall rack.

The rod has extending from both ends a flange 6 and 20 (FIG. 1) and 22 (FIG. 2) accommodating holes 7 and 21 respectively so that either the top flange or bottom flange, or both flanges of the rod may rest on the top hinge and/or bottom hinge of a door. This permits the corresponding pin of a door hinge to be inserted through the respective flange and into the door hinge.

Figure 3:
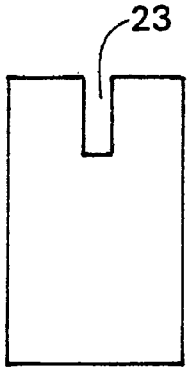
FIG. 3 is an enlarged cross-section of the catchall rack showing the slot in back.
Figure 4:
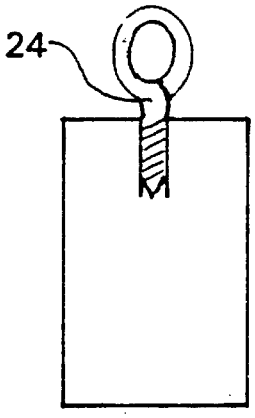
FIG. 4 is an enlarged cross-section of the catchall rack showing a screw eye screwed into the slot.
Figure 5:
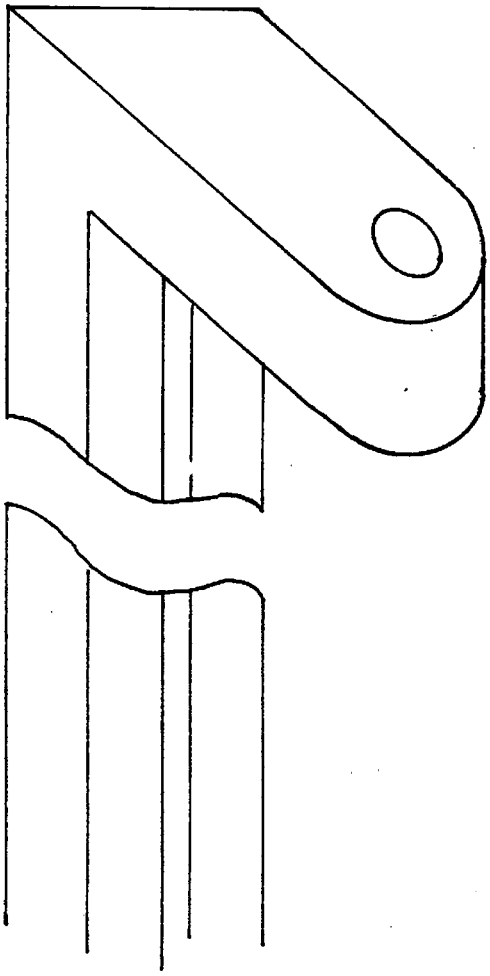
FIG. 5 is an isometric view of the back of the catchall rack showing the slot.

To accommodate door hinges which may not be spaced precisely with the rod flanges, groove or slot depicted by 23 (FIG. 3) and again by 25 (FIG. 5) will receive and hold a plurality of screw eyes 24 (FIG. 4) anywhere along the rod so that a plurality of screw eyes may be pinned on to a plurality of hinges anywhere along a door. Furthermore, selected location of these screw eyes allows the catchall rack to be raised or lowered along the door hinges.

A present preferred embodiment of the present invention has been described with a degree of specificity. It should be understood, however, that this degree of specificity is directed to the preferred embodiment. For example, the rod with the plurality of catchall items extending from it could be rounded tubular material made of wood, metal, plastic, fiberglass, etc. which is slotted in back. Similarly, the screw eyes could be made of washer-type disks with a barbed extension to insert into the slot. Also, different catchall designs can be appended to the rod. The present invention itself, however, is defined by the scope of the appended claims.

The invention claimed is:

1. A catchall storage rack adapted to be secured to door hinges, said storage rack comprising an elongated rod, said rod adapted to be of a sufficient length to extend from above a top of topmost door hinge to a top of a bottommost door hinge, each end of said rod having an outwardly extending flange with a hole formed therein whereby the holes of said flanges are adapted to be aligned with pins of said door hinges so that the rod can be held to said door hinges by inserting said door hinge pins through a corresponding flange and into the door hinge, and said rod having at least one longitudinal slot or groove formed in a back surface and a plurality of screw-eye type devices secured at points within the slot or groove along the rod whereby the slot or groove accommodates the ease of insertion of said screw-eye type devices and whereby the screw-eye type devices are adapted alternatively to receive the pins of said door hinges in lieu of said flanges.

2. A catchall storage rack as set forth in claim 1, said rod having a loop or ring secured thereto, whereby the said loop or ring is adapted to accommodate and hold in place the muzzle of a pistol or barrel of a rifle, and said rod having a tray spaced below said loop or ring and secured thereto, said tray adapted to serve as a cradle for a handle of the pistol or a stock of said rifle.

3. A catchall storage rack as set forth in claim 1, wherein said rod has a plurality of trays or cups or pegs secured thereto.

* * * * *